United States Patent [19]

Sawada et al.

[11] 4,176,539

[45] Dec. 4, 1979

[54] COLD-ROLL FORMING STAND

[75] Inventors: Takeshi Sawada, Yonago; Takeshi Inoue, Yasugi, both of Japan

[73] Assignee: Hitachi Metals, Inc., Japan

[21] Appl. No.: 887,251

[22] Filed: Mar. 16, 1978

[30] Foreign Application Priority Data

Mar. 25, 1977 [JP] Japan ..... 52-32166

[51] Int. Cl.[2] ..... B21D 5/06

[52] U.S. Cl. ..... 72/178; 72/181; 72/225

[58] Field of Search ..... 72/178, 181, 182, 225

[56] References Cited

U.S. PATENT DOCUMENTS

| | | | |
|---|---|---|---|
| 1,955,783 | 4/1934 | Yoder | 72/225 |
| 2,505,241 | 4/1950 | Gray et al. | 72/181 |
| 3,748,884 | 7/1973 | Colbath | 72/181 |
| 3,938,362 | 2/1976 | Falk et al. | 72/225 |

*Primary Examiner*—Milton S. Mehr
*Attorney, Agent, or Firm*—Craig and Antonelli

[57] ABSTRACT

A cold-roll forming stand for forming a flat metal strip into a desired section which includes a pair of upper and lower forming rolls for forming the metal strip lengthwise; a pair of intermediate longitudinal forming rolls for bending or curving the metal strip widthwise are mounted on intermediate vertical shafts, a pair of front longitudinal forming rolls mounted on vertical shafts upstream of the pair of intermediate longitudinal forming rolls and a pair of rear longitudinal forming rolls are mounted on vertical shafts downstream of the pair of intermediate longitudinal forming rolls, whereby the metal strip is subjected to the bending and/or curving lengthwise by the pair of upper and lower forming rolls and widthwise by the front, intermediate and rear pairs of longitudinal forming rolls.

3 Claims, 7 Drawing Figures

COLD-ROLL FORMING STAND

The present invention relates to generally a cold-roll forming mill including a plurality of cold-roll forming stands some of which may exert the forming forces both lengthwise and widthwise to a flat metal strip being formed and more particularly a cold-roll forming stand capable of exerting greater forming forces hitherto unattainable by any of the conventional cold-roll forming stands.

In cold-roll forming, a flat metal strip is fed lengthwise between pairs of mating forming rolls mounted in stands in tandem so that the pairs of forming rolls each progressively share in forming the flat metal strip into a desired section. Various combinations of various types of cold-roll forming stands are used depending upon the final section, the metal strip and the thickness of the metal strip. The distance between the adjacent cold-roll forming stands must be reduced as practically as possible especially when a thin metal strip, which tends to cause springback and be bent or curved easily in the widthwise direction, is formed into a complex section. Alternatively, an intermediate stand must be disposed between the adjacent cold-roll forming stands in order to overcome springback and to avoid buckling. However, the conventional cold-roll forming mills are still unsatisfactory for forming some sections. For instance, if it is desired to form a bumper for an automotive vehicle by cold-roll forming, a flat metal strip must be formed in such a way that both sides are lengthwise curved inwardly with a predetermined curvature, whereby the formed bumper may have inwardly curved lips. However, the lip portions are easily susceptible to buckling, and when excessive forming forces are exerted, seizure of the metal strip occurs surface flaws of forming rolls appear on the final products, and excessive deformations of the products occur. These problems may be partially overcome by the reduction in distance between the adjacent cold-roll forming stands and by the intermediate stand between the adjacent cold-roll forming stands as described above. However, the reduction in distance between the adjacent cold-roll forming stands is limited because of the rigidity of forming stands including their bearings, gear boxes and so on. Furthermore only one pair of side rolls are mounted on the intermediate stand.

In order to overcome the above problems there has been proposed a cold-roll forming stand wherein a pair of longitudinal forming rolls are mounted in the spaces between the vertical upright frames and the upper and lower rolls so that the metal strip may be subjected to the bending and/or curving both lengthwise and widthwise. However, this cold-rolling forming stand is yet unsatisfactory in forming a special complex section.

One of the objects of the present invention is therefore to provide a cold-roll forming stand capable of forming both lengthwise and widthwise a flat metal strip into a desired complex section.

Another object of the present invention is to provide a cold-roll forming stand especially adapted for bending a flat metal strip lengthwise with a predetermined curvature, whereby a bumper-like product having both sides curved inwardly like a lip may be obtained.

To the above and other ends, the present invention provides a cold-roll forming stand wherein a pair of upper and lower transverse forming rolls for forming lengthwise a flat metal strip are mounted on a pair of upper and lower transversely extending shafts; right and left pairs of upper and lower housings are mounted on the pairs of upper and lower shafts with the pair of upper and lower transverse shafts being extended transversely through the housings. A pair of intermediate longitudinal forming rolls for forming widthwise the metal strip are mounted between the pair of upper and lower transversely extending shafts at center portions of the right and left pairs of upper and lower housings through which are extended the pairs of upper and lower transversely extending shafts. One or more pairs of longitudinal forming rolls are mounted upstream of the pair of intermediate longitudinal forming rolls and between the upper and lower housings while one or more pairs of longitudinal forming rolls are mounted downstream of the pair of intermediate longitudinal forming rolls and between the upper and lower housings, whereby the metal strip is subjected to the bending and/or curving not only lengthwise by the pair of upper and lower forming rolls but also widthwise by the pair of intermediate forming rolls and the front and rear pairs of forming rolls upstream and downstream of the pair of intermediate forming rolls. The intermediate forming rolls and forming rolls upstream and downstream of the intermediate forming rolls are especially forcible for positively bending the metal strip widthwise. As a result, the effects same with those attained when the distance between the adjacent cold-roll forming stands is reduced as practically as possible in the conventional cold-roll forming mill may be achieved. Furthermore the simultaneous lengthwise and widthwise bendings can achieve powerful effects on forming a flat metal strip into a complex section so far unachievable with the conventional cold-roll forming stands.

Figure 1:
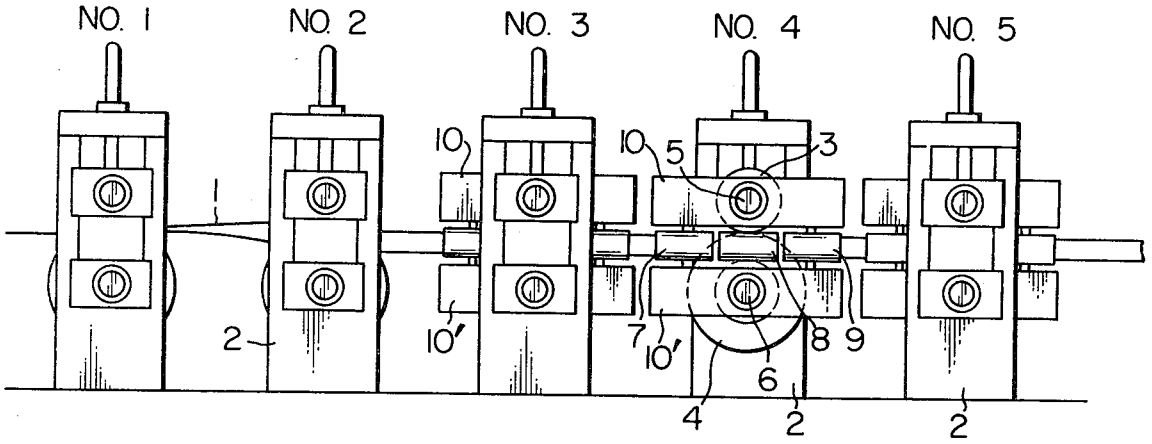
FIG. 1 is a schematic side view of a cold-roll forming mill including cold-roll forming stands in accordance with the present invention.

In FIG. 1 there is shown a schematic side view of a cold-roll forming mill consisting of five stands No. 1–No. 5 for forming a flat metal strip into a desired section. In FIG. 1, the No. 4 stand is shown with one upright frame 2 removed. 1 is a flat metal strip; 2, the upright frame; 3, an upper transverse forming roll; 4, a lower transverse forming roll; 5, an upper transversely extending shaft; 6, a lower transversely extending shaft; 7 and 9, pairs of longitudinal forming rolls; 8, a pair of intermediate longitudinal forming rolls; and 10 and 10', upper and lower housings. The upper and lower transverse rolls 3, 4 are adapted to engage the upper and lower surfaces of the metal strip 1 as the strip passes through the cold-roll forming stands. When the metal strip 1 is passed through the cold-roll forming stands, a cold-roll forming device in accordance with the present invention is incorporated into each of the cold-roll forming stands starting from the stand No. 3. The present invention is characterized in a construction wherein pairs of upper and lower housings 10 and 10' and 11 and 11' are disposed inwardly of the upright frames 2 and extending longitudinally in parallel with the pass or travel of the metal strip 1. The upper and lower shafts 5 and 6 are extended through the pairs of the upper and lower housings 10 and 10' and 11 and 11' and two pairs of longitudinal forming rolls 7 and 9 are mounted on vertical shafts which, in turn, are supported between the pairs of upper and lower housings 10 and 10' and 11 and 11' and which are spaced apart from each other by a suitable distance in the longitudinal direction. The pair of intermediate longitudinal forming rolls 8 are mounted on intermediate vertical shafts between the front and rear pairs of the forming rolls 7 and 9 with the axes of the intermediate vertical shafts of the intermediate forming rolls 8 being in a coplanar relationship with the axes of the upper and lower forming rolls 3 and 4. When the cold-roll forming stands with the above construction are positioned in tandem, the effects are the same as the effects which can be obtained when the spacing between the adjacent forming stands is reduced as practically as possible in a conventional cold-roll forming mill. As a result, the metal strip 1 may be forced to bend not only in the longitudinal direction but also in the transverse direction under the greater forming forces. Thus, the cold-roll forming mill including the cold-roll forming stands in accordance with the present invention may bend a flat metal strip into a very complex section which has been hitherto unattainable with the conventional cold-roll forming mills. Furthermore the cold-roll forming efficiency may be remarkably improved.

Figure 2:
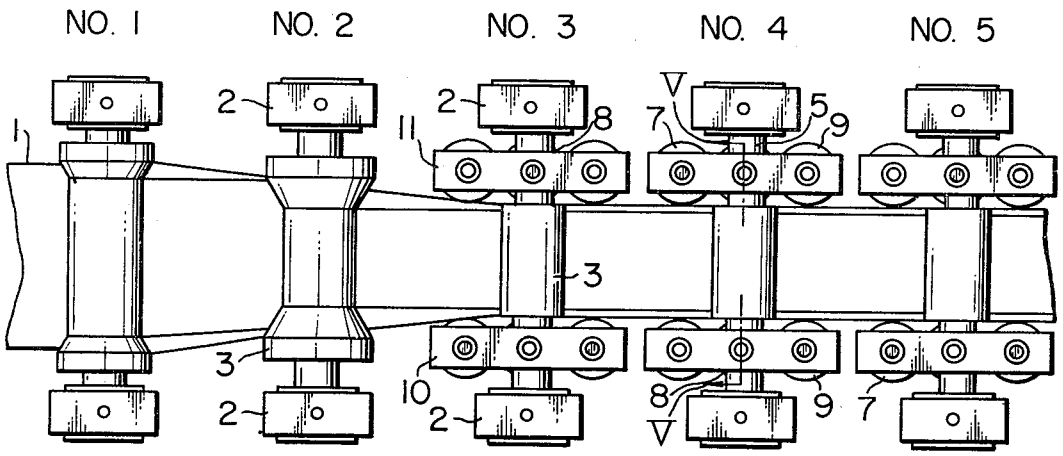
FIG. 2 is a top view thereof.

FIG. 2 is a top view of the cold-roll forming mill shown in FIG. 1. In each stand, the upper and lower shafts 5 and 6 are supported between the pair of upright frames 2, and the pairs of upper and lower housings 10 and 10' and 11 and 11', extending in parallel with the pass of the metal strip 1, are disposed between the upright frames 2 and the upper and lower forming rolls 3 and 4. The vertical shafts which carry the front and rear pairs of forming rolls 7 and 9 are supported between the upper and lower housings 10 and 10' and 11 and 11' as will be described in detail hereinafter.

Figure 3:
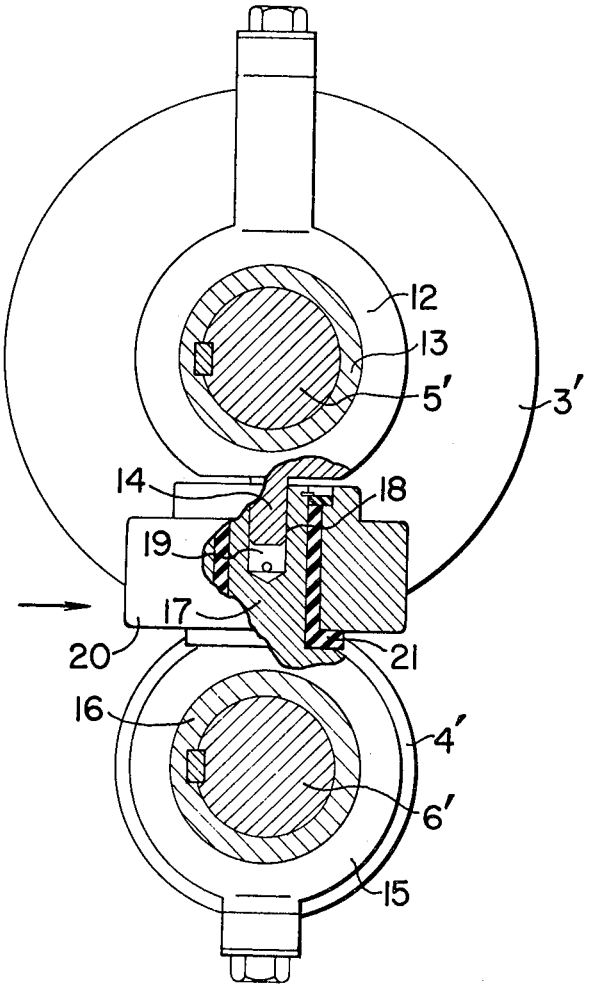
FIG. 3 PRIOR ART
FIG. 3 is an elevational partially sectioned view of transverse forming rolls provided with a longitudinal forming roll of the prior art.

FIG. 3 is an elevational partially sectioned view of transverse forming rolls provided the conventional longitudinal forming roll. In the conventional cold-roll forming stand, the longitudinal forming rolls for a widthwise forming of the metal strip are disposed between the upper and lower transverse forming rolls and the pair of upright frames outside of both ends of the upper and lower transverse forming rolls.

The upper transverse forming roll is mounted on the upper transversely extending shaft and the lower transverse forming roll is mounted on the lower transversely extending shaft and the upper and lower transverse forming rolls are driven by the upper or the lower transversely extending shafts or, in case of necessity the upper and lower transversely extending shafts and form the metal strip which is fed in a direction of the arrow in FIG. 3 while rotating in an opposite direction to each other. Right and left upper bosses are respectively engaged with the upper transversely extending shafts, and are disposed between the upper transverse forming roll and the upright frames so as to mount longitudinal forming rolls. The lower central portions of the upper bosses are provided with center bearings having a projection and on the other hand, right and left lower bosses respectively engaged with the lower transversely extending shafts, are disposed between the lower transverse roll and the upright frames. The upper portions of the lower bosses are provided with vertical shafts having axial holes at upper ends thereof. The center bearings of the upper bosses are inserted into the axial holes of the vertical shafts of the lower bosses so that the pair of right and left vertical shafts are assembled and the longitudinal forming rolls are inserted into each vertical shaft through a sleeve and the pair of longitudinal forming rolls run idle on the sleeve. Further, the axes of the vertical shafts of the longitudinal forming rolls are in a coplanar relationship with the axes of the upper and lower transverse forming rolls.

In FIG. 3, 3' is the upper transverse forming roll; 4', the lower transverse forming roll; 5', the upper transversely extending shaft; and 6', the lower transversely extending shaft; an upper boss 12 runs idle on a collar 13 mounted on the upper shaft 5' and the upper boss 12 is provided a center bearing 14. A lower boss 15 runs idle on a collar 16 mounted on the lower shaft 6' and the lower boss 15 is provided a vertical shaft 17 having an axial hole 18 at upper end thereof. The center bearing 14 of the upper boss 12 is inserted into the axial hole 18 of the vertical shaft 17. A space 19 is provided between the axial hole 18 and the center bearing 14 so that a distance between the upper shaft 5' and the lower shaft 6' may be adjusted. The vertical shaft 17 is inserted into a longitudinal forming roll 20 for the widthwise forming of the metal strip through a sleeve 21, whereby, the metal strip may be lengthwise formed by means of the upper and lower forming rolls 5' and 6' and, may be simultaneously widthwise formed by means of the right and left rolls 20 and 20 widthwise.

Figure 4:
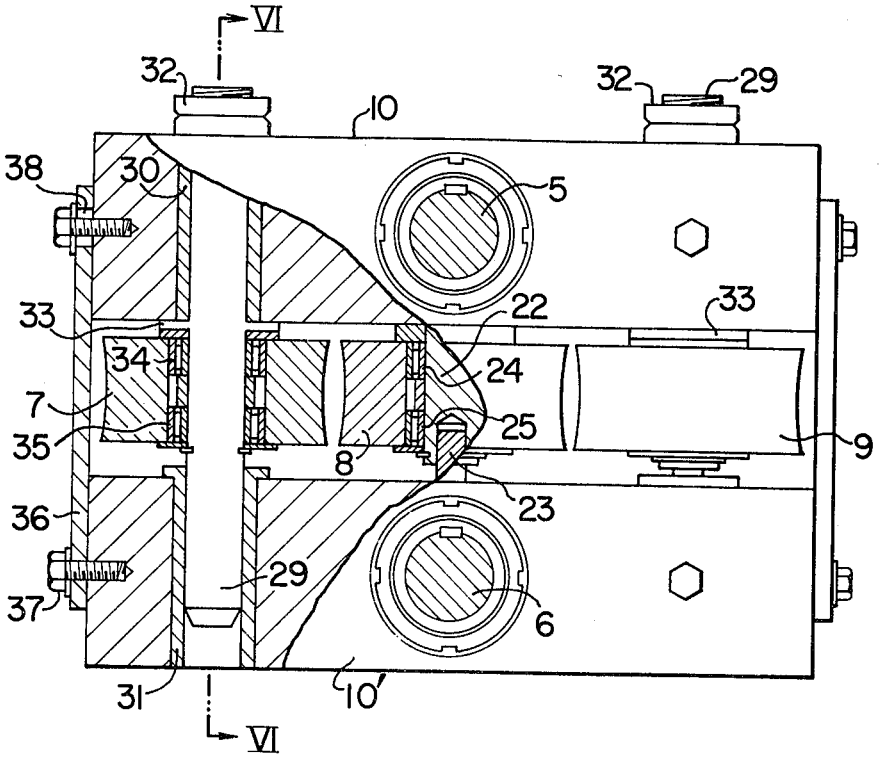
FIG. 4 is an elevational partially sectioned view of housings in accordance with the present invention.

FIG. 4 is an elevational partially sectioned view, on enlarged scale, of housings of the cold-roll forming stand in accordance with the present invention. An intermediate vertical shaft 22, which is mounted on the upper shaft 5 in a manner to be described in detail hereinafter, has an axial hole drilled or otherwise formed from the lower end thereof. A center bearing 23, which is mounted on the lower shaft 6 in a manner to be described in detail hereinafter, has a center or a projection which is snuggly fitted into the axial hole of the intermediate vertical shaft 22. As, the axes of the intermediate vertical shaft 22 and the center bearing 23 are in a coplanar relationship with the axes of the upper and lower transverse shafts 5 and 6. The intermediate forming roll 8 is mounted on the intermediate vertical shaft 22 through two vertically spaced apart needle bearings 24 and 25.

Figure 5:
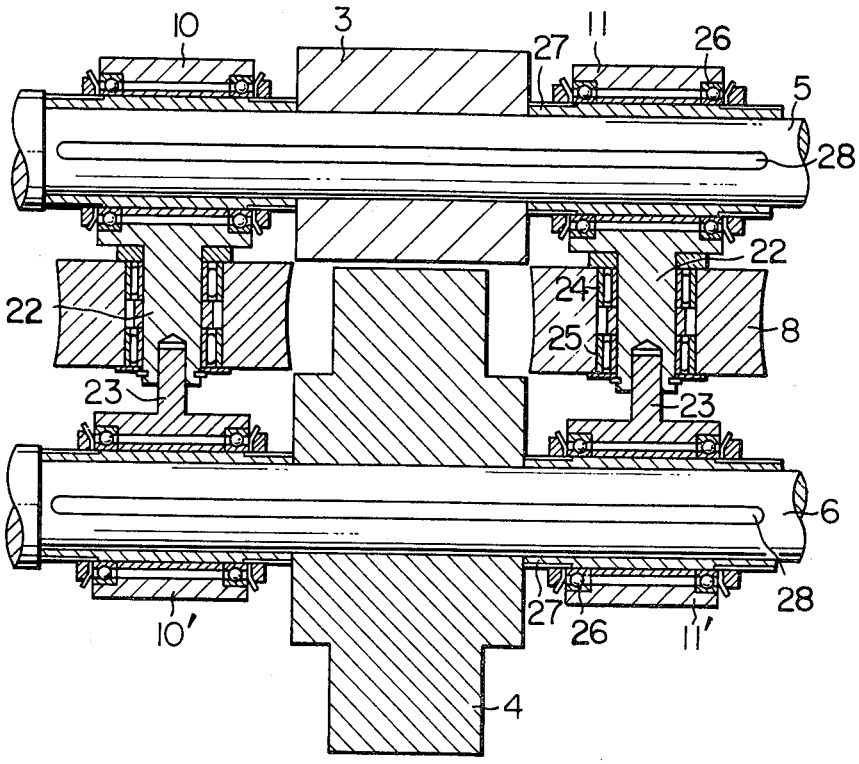
FIG. 5 is a sectional view taken along the line indicated by arrows V—V of FIG. 2.

FIG. 5 shows in more detail the construction of the intermediate forming roll 8. A through hole formed through the upper portion of the intermediate vertical shaft 22, coaxially of the upper shaft 5 is loosely fitted through a bearing 26 over a collar 27 which, in turn, is keyed to the upper shaft 5 with a key 28. In like manner, a through hole formed through the lower portion of the center bearing 23, coaxially of the lower shaft 5 is loosely fitted through a bearing 26 over a collar 27 which, in turn, is keyed to the lower shaft 6 by a key 28. The center or the projection of the center member 23 is fitted into the mating axial hole of the vertical shaft 22, whereby the intermediate roll 8 may be correctly positioned.

Referring back to FIG. 4, the front pair of front forming rolls 7, on each side of the metal strip 1, are each disposed upstream of the pair of intermediate forming rolls 8. In like manner, the rear pair of forming rolls 9 are disposed downstream of the pair of intermediate rolls 8. Since the front and rear pairs of forming rolls 7 and 9 are substantially similar in construction, only the front pair of forming rolls 7 will be described hereinafter.

A vertical shaft 29 is fitted through a bushing 30 and a bushing 31 into mating vertical holes of the upper and lower housings 10 and 10', and nuts 32 are fastened to the upper end of the vertical shaft 29 and tightened so that a flange 33 of the vertical shaft 29 may securely bear against the bottom surface of the upper housing 10, whereby the vertical shaft 29 may be securely held in position. This arrangement is advantageous in that the assembly and disassembly of the pair of front forming rolls 7 may be greatly facilitated. The front forming rolls 7 are each mounted on the vertical shaft 29 through bearings 34 and 35 between the upper and lower housings 10 and 10'.

In order to ensure sufficient rigidity of the housings 10 and 10' and the pair of front forming rolls 7 against the cold-roll forming of the metal strip 1, the upper and lower housings 10 and 10' are connected with a connecting plate 36 which is securely attached to them with bolts 37. It is preferable that the connecting plate 36 is formed with vertically elongated slot 38 through which are extended the bolts 37 because the distance between the upper and lower housings 10 and 10' must be changed as the distance between the upper and lower forming rolls 3 and 4 must be changed due to the wear of the forming rolls 3 and 4. In order to increase the rigidity of the cold-roll forming stand, it is preferable to interconnect the right and left housings 10 and 11 and 10' and 11' by connecting plates similar to the connecting plate 36.

Figure 6:
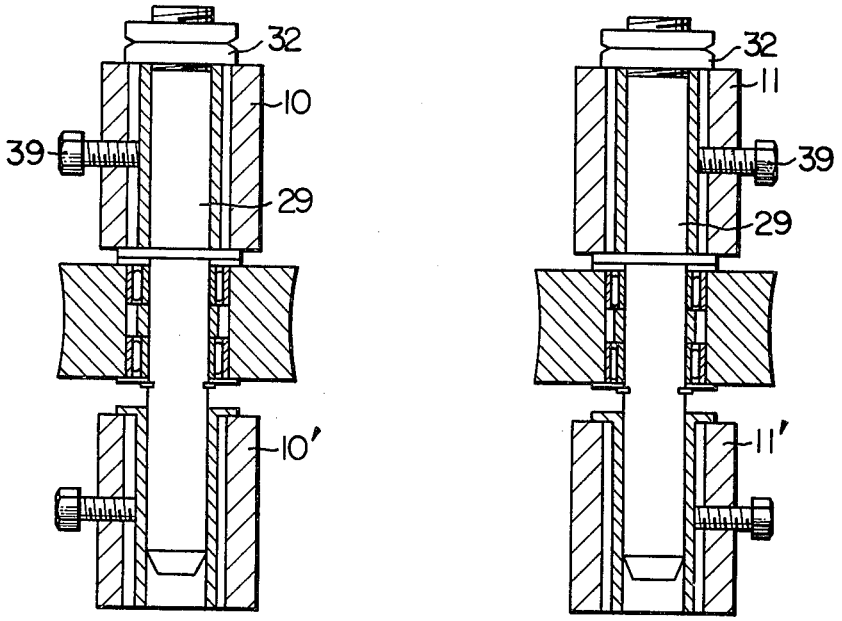
FIG. 6 is a partially sectional view taken along the line indicated by VI—VI of FIG. 4.
Figure 7:
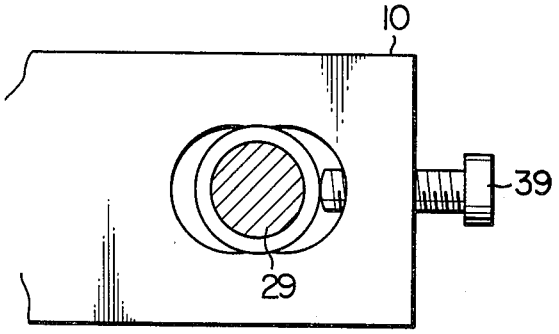
FIG. 7 is a fragmentary top view, on enlarged scale, of the upper housing showing an arrangement for shifting a vertical shaft in the transverse direction.

FIG. 6 is a vertical sectional view of the front and rear pairs of forming rolls 7 and 9 taken in the direction indicated by the arrows VI—VI of FIG. 4. The description will be again limited to the front pairs of forming rolls 7. As described above, the vertical shaft 29 is securely held in position with the nuts 32. As best shown in FIG. 7, the vertical holes of the housings 10 and 10' are transversely elongated so that the vertical shaft 29 may be transversely movable and consequently the distance or spacing between the pair of front forming rolls 7 may be adjustable. That is, the vertical shaft 29 may be shifted transversely by tightening or untightening an adjusting screw or bolt 39.

So far the present invention has been described in conjunction with the cold-roll forming mill consisting of five cold-roll forming stands, but it will be understood that the present invention is not limited thereto. The number of cold-roll forming stands in accordance with the present invention in one cold-roll forming mill must be increased or decreased depending upon various cold-roll forming factors such as the final section, the quality of the product, the material of the metal strip and the thickness of the metal strip. So far the vertical shaft has been described as carrying only one longitudinal forming roll, but it will be understood that a plurality of longitudinal forming rolls may be mounted on one vertical shaft as needs demand. Furthermore, additional pairs of longitudinal forming rolls which are substantially similar in construction to the pairs of front and rear longitudinal forming rolls 7 and 9 may be disposed upstream of the pair of front longitudinal forming rolls 7 and downstream of the rear longitudinal forming rolls 9.

As mentioned above, the present invention and the conventional cold-roll forming stand are explained in detail and a fundamental difference between constitution of the present invention and that of the prior art is as follows;

(1) The housings through which are extended the upper and lower transversely extending shafts are provided within the same one stand.

(2) The pairs of the longitudinal forming rolls are provided for widthwise forming of the strip.

A large meritorious effect is ensured due to the above two points of the present invention being carried out as compared with the conventional forming roll stand. Namely as mentioned above, for instance, a predetermined product having inwardly curved lip such as lip portions of the bumper of the automotive vehicle and the like, may be formed so as to make narrow a distance between the forming roll stands, but a size of the conventional forming roll stand is limited due to a size of the product so that the distance between the forming roll stands cannot make narrow over the definite distance.

According to the present invention the product is formed easily due to the right and left pairs of longitudinal forming rolls provided within the same forming roll stand together with forming work by the conventional forming roll stands provided center portions thereof so as to simultaneously form lengthwise and widthwise the strip, whereby the strip may be accurately formed and a heavy forming work may be possible as compared with the conventional single forming roll stand so that the forming work of the bumper of the automotive vehicle may be possible with very remarkable meritorious effects.

In summary, the present invention provides a cold-roll forming stand wherein the pair of upper and lower transverse forming rolls 3, 4 are mounted on the upper and lower transversely extending shafts 5, 6, respectively, so that the metal strip 1 may be passed therethrough lengthwise. The pair of intermediate longitudinal rolls 8 are disposed such that each intermediate roll 8 is mounted on the intermediate vertical shaft 22 which is mounted on the upper shaft 3 through a housing and which is centered by the center bearing member 23 which, in turn, is mounted on the lower shaft 4, through the housing with the axes of the intermediate vertical shaft 2 and the center bearing member 23 being in a coplanar relationship with the axes of the upper and lower shafts 3, 4. The right and left pairs of upper and lower housings 10, 10', 11, 11', through which are extended the upper and lower shafts 3, 4, on the one hand, are disposed between the right and left upright frames 2 of the stand and respective sides of the metal strip, and, on the other hand, in parallel with the pass of the metal strip 1. One or more pairs of longitudinal forming rolls 7 are disposed upstream of the pair intermediate forming rolls 8 while one or more pairs of longitudinal forming rolls 9 are disposed downstream of the pair of intermediate forming rolls 8 with each forming roll 7, 8, 9 being mounted on a vertical shaft which is supported by the corresponding pair of upper and lower housings 10, 10', 11, 11'. Therefore, the metal strip 1 is formed not only from the vertical direction but also from the horizontal direction, whereby the metal strip may be bent into a desired complex section hitherto unattainable with the conventional cold-roll forming stands and with higher efficiency and in a very simple manner.

We claim:

1. A cold-roll forming mill which includes one or a plurality of cold-roll forming stands positioned in tandem for forming a flat metal strip into a desired section, said cold-roll forming stand comprising:

a pair of upper and lower transverse forming rolls adapted to engage an upper and lower surface of the flat metal strip for a lengthwise forming of said flat metal strip;

a pair of upper and lower transversely extending shafts for respectively mounting the pair of upper and lower transverse forming rolls;

a pair of intermediate longitudinal forming rolls for a widthwise forming of said flat metal strip;

a pair of upper and lower housing means extending parallel to a pass direction of the metal strip through the forming stand and being disposed on respective lateral sides of the metal strip for mounting said pair of intermediate longitudinal rolls to said upper and lower transversely extending shafts such that one of said intermediate longitudinal forming rolls is disposed on one lateral side of the metal strip and the other of said intermediate longitudinal forming rolls is disposed on the other lateral side of the metal strip, said upper and lower transversely extending shafts extending through said housing means;

a pair of additional longitudinal forming rolls for widthwise forming of said flat metal strip mounted on said pair of upper and lower housing means at a position upstream of said pair of intermediate longitudinal forming rolls, such that said additional longitudinal forming rolls are disposed on respective lateral sides of the flat metal sheet; and a further pair of longitudinal forming rolls for widthwise forming of said flat metal strip mounted on said pair of upper and lower housing means at a position downstream of said pair of intermediate longitudinal forming rolls such that said further longitudinal forming rolls are disposed on respective lateral sides of the flat metal sheet, whereby said flat metal strip is subjected to both a lengthwise and widthwise bending and curving.

2. A cold-roll forming mill which includes one or a plurality of cold-roll forming stands positioned in tandem for forming a flat metal strip into a desired section, said cold-roll forming stand comprising:

a pair of upper and lower transverse forming rolls respectively mounted on a pair of upper and lower transverse shafts for a lengthwise forming of said flat metal strip;

a pair of intermediate longitudinal forming rolls for a widthwise forming of said flat metal strip mounted on said upper and lower transverse shafts through a pair of upper and lower housings through which are extended said upper and lower transverse shafts, said pair of intermediate longitudinal forming rolls are such that each longitudinal forming roll is loosely mounted on an intermediate vertical shaft which in turn is mounted on one of said pair of upper and lower housings in a position away from said upper or lower transverse shaft and which is centered by a center bearing member which in turn is mounted on the other housing;

pairs of longitudinal forming rolls for widthwise forming of said flat metal strip mounted on said pair of upper and lower housings upstream and downstream of said intermediate longitudinal forming rolls, said pairs of longitudinal forming rolls for widthwise forming of said metal strip are mounted on a plurality of vertical shafts mounted by said pairs of upper and lower housings upstream and downstream of said pair of intermediate longitudinal forming rolls, whereby said flat metal strip is subjected to both a lengthwise and widthwise bending and curving.

3. A cold-roll forming mill which includes one or a plurality of cold-roll forming stands positioned in tandem for forming a flat metal strip into a desired section, a cold-roll forming stand comprising:

a pair of upper and lower transverse forming rolls respectively keyed to a pair of upper and lower transversely extending shafts for lengthwise forming of the flat metal strip;

a collar keyed to one of said upper and lower transversely extending shafts at a position spaced from the transverse forming roll carried by said one transversely extending shaft;

a vertical shaft for carrying an intermediate longitudinal forming roll mounted on said collar by a bearing for widthwise forming of the flat metal strip;

a collar keyed to the other of said transversely extending shafts at a position spaced from the transverse forming roll carried by said other transverse shaft;

a center bearing member loosely mounted on said collar on said other transversely extending shaft through a bearing and fitted into said vertical shaft for said intermediate longitudinal forming roll, said center bearing member being in a coplanar relationship with longitudinal axes of said pair of upper and lower transversely extending shafts;

bearing means for rotatably mounting said intermediate longitudinal forming roll on said vertical shaft;

pairs of upper and lower housings disposed on respective lateral sides of the metal strip, said pair of upper and lower transversely extending shafts respectively extending through said upper and lower housings;

a plurality of additional vertical shafts attached with fastening means to said pairs of upper and lower housings upstream and downstream of said pair of intermediate longitudinal forming rolls; and at least one additional longitudinal forming roll for widthwise forming of said flat metal strip rotatably mounted on each of said plurality of additional vertical shafts, whereby said metal strip is formed both lengthwise and widthwise.

* * * * *